United States Patent [19]

Carpenter et al.

[11] Patent Number: 4,561,220

[45] Date of Patent: Dec. 31, 1985

[54] PORTABLE ABRASIVE THROWING WHEEL DEVICE

[75] Inventors: James H. Carpenter; Ronald L. Mullins; Ronald L. Smith, all of Hagerstown, Md.

[73] Assignee: Kennecott Corporation, New York, N.Y.

[21] Appl. No.: 681,512

[22] Filed: Dec. 13, 1984

Related U.S. Application Data

[63] Continuation of Ser. No. 509,664, Jun. 30, 1983, abandoned, which is a continuation of Ser. No. 223,026, Jan. 6, 1981, abandoned.

[51] Int. Cl.[4] ..... B24C 5/04

[52] U.S. Cl. ..... 51/427; 51/428; 51/431; 51/436

[58] Field of Search ..... 51/410, 424, 426–428, 51/431, 432, 435, 436, 438; 408/187, 238; 248/317, 329, 332

[56] References Cited

U.S. PATENT DOCUMENTS

| | | | |
|---|---|---|---|
| 818,776 | 4/1906 | Murray | 51/424 |
| 2,263,321 | 11/1941 | Unger | 51/431 |
| 3,032,308 | 5/1962 | Hansen | 248/329 |
| 3,182,425 | 5/1965 | Goss et al. | 51/410 |
| 3,680,186 | 8/1972 | Symington | 51/431 X |
| 3,777,440 | 12/1973 | Yamanoto et al. | 51/431 |
| 3,863,392 | 2/1975 | Haker | 51/426 |
| 4,064,656 | 12/1977 | Zeidler | 51/426 |

FOREIGN PATENT DOCUMENTS

| | | | |
|---|---|---|---|
| 718638 | 11/1954 | United Kingdom | 51/436 |
| 629052 | 9/1978 | U.S.S.R. | 51/435 |

*Primary Examiner*—James G. Smith

*Attorney, Agent, or Firm*—R. L. Sahr; B. J. Kearns; H. M. Snyder

[57] ABSTRACT

This relates to a portable abrasive throwing wheel device or abrasive blasting device which is utilized for blasting castings and the like to effect the cleaning thereof. The portable device is of such a construction whereby its total weight is on the order of 100 pounds and is so suspended wherein it has very little thrust reaction on an operator so that it may be readily manipulated. Further, the principal thrust of the device is carried by the suspension for the device and otherwise is directed towards the operator so that it may be readily counteracted. The portable device includes a fixed motor and a fixed abrasive supply with a throwing wheel carried by the motor and only a housing portion being movable. The housing is rotatable about the axis of the motor and serves to permit the discharge opening of the device to be tilted to the desired angle for directing the abrasive blast where desired. Several abrasive supply systems are provided as are several mountings for the portable device.

8 Claims, 19 Drawing Figures

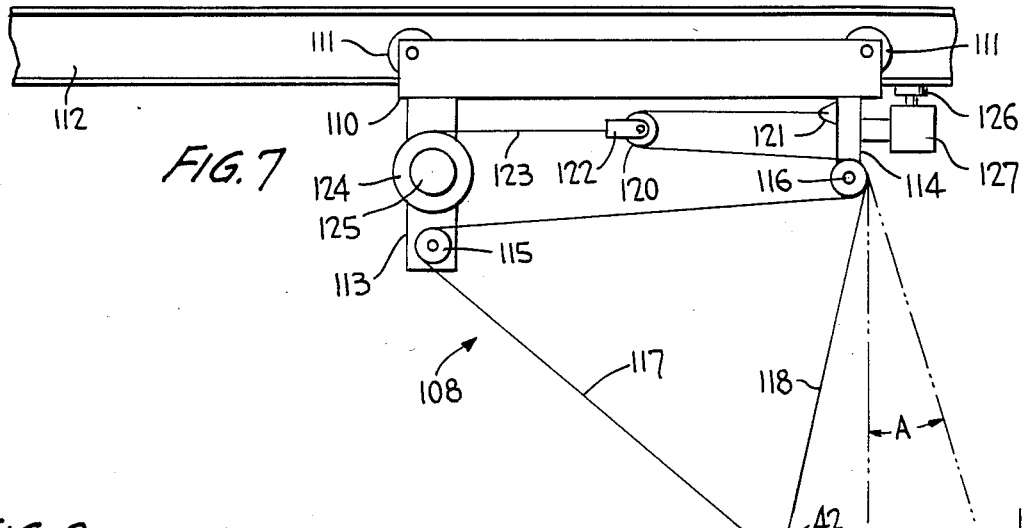
FIG. 7
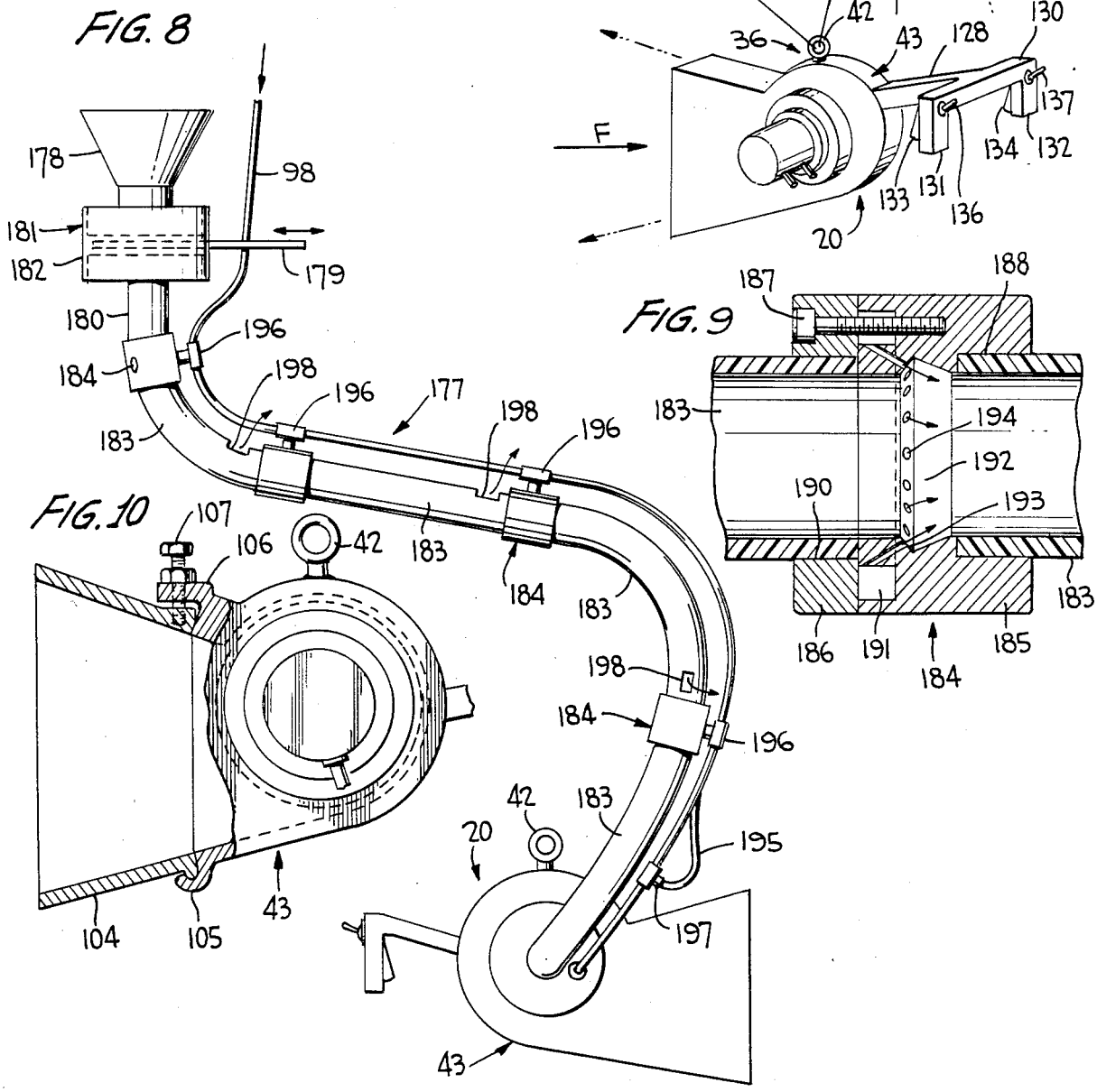
FIG. 8
FIG. 9
FIG. 10

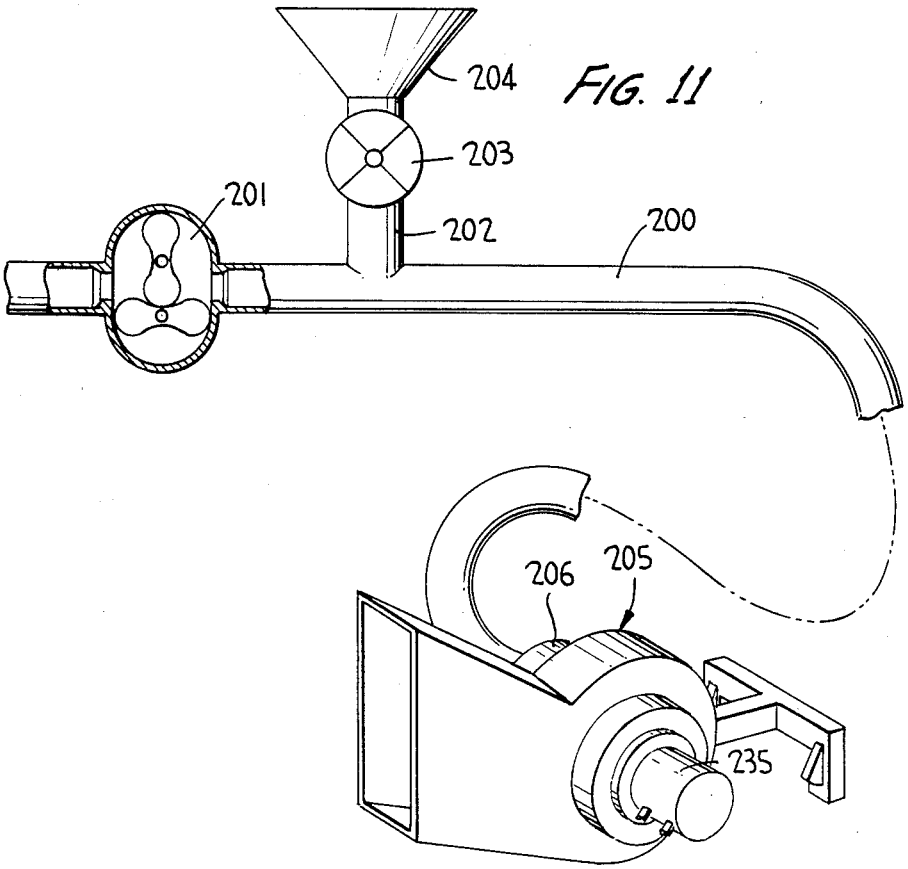
FIG. 11
FIG. 16
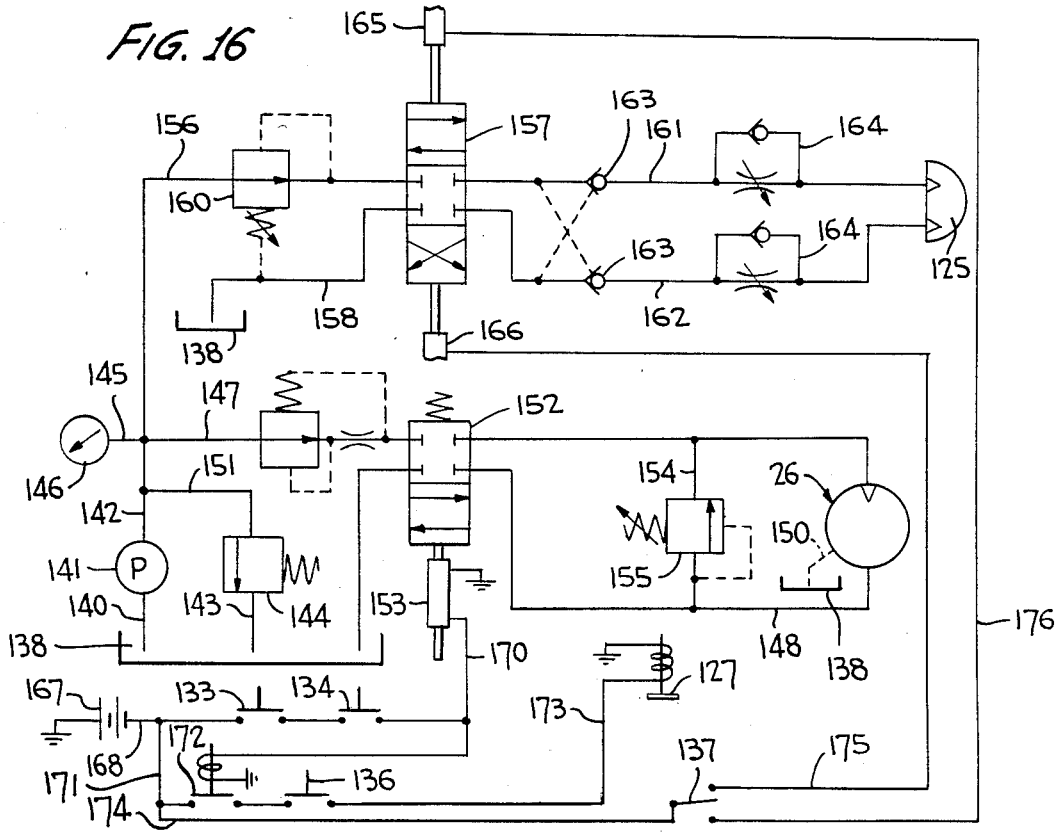

PORTABLE ABRASIVE THROWING WHEEL DEVICE

This application is a continuation of Ser. No. 509,664, filed June 30, 1983, which is a continuation of Ser. No. 223,026, filed Jan. 6, 1981; both now abandoned.

This invention relates in general to new and useful improvements in abrasive blasting devices, and more particularly to a portable abrasive blasting wheel device.

It has been recognized for years that it would be advantageous to have a blasting device or abrasive throwing wheel device that would fill the cleaning rate or blast power gap that exists between a maneuverable, low output, compressed air blast nozzle and a cumbersome high output centrifugal throwing wheel device. The obvious solution was to have a light weight, small diameter centrifugal throwing wheel that is maneuverable, and can be handled by one man in much the same way as the compressed air blast nozzle. The idea of a portable abrasive throwing wheel device is not new. As early as 1940 there was conceived a portable abrasive blasting wheel device which could be readily suspended and handled by one man. Attention is directed to the patent to Unger U.S. Pat. No. 2,263,321, granted Nov. 18, 1941. Unfortunately, for a number of reasons which will not be discussed here, the machine of the Unger patent was not commercially promoted.

It is, however, pointed out here that in past years, in order to obtain the high horsepower output needed, large electric motors were required which, in turn, resulted in heavy cumbersome units. Another approach has been to use high speed air motors and a small diameter throwing wheel. This arrangement will provide the necessary abrasive speed in a small package. However, since the horsepower is limited, usually to less than 5 horsepower for a practical unit, the volume or mass of the abrasive was greatly restricted.

In recent years, manufacturers have developed high speed (up to 10,000 RPM) hydraulic motors. For example, one hydraulic motor can develop up to 32 horsepower at 6,000 RPM and yet weighs only 17 pounds.

In addition to the motor weight and size problem, there have been other practical problems that have not heretofore been solved.

In accordance with this invention, there has been developed a hand manipulated abrasive throwing wheel device that develops relatively high horsepower yet is compact and maneuverable.

There has also been developed an abrasive feed system which will feed the throwing wheel throughout the range of positions and attitudes required for practical blast cleaning.

There has also been developed a mechanical assist system which will aid in manipulating the throwing wheel device and will help resist the reaction forces of the wheel.

There has also been developed a throwing wheel and housing contruction that is completely safe with regard to injuring the operator, yet provides for reasonable wear life.

There has also been developed an operating sytem which makes the utilization of the portable abrasive throwing wheel device practical and safe to use.

Most particularly, the throwing wheel operates in a generally vertical plane which will generally pass through the operator so that the operator may readily react the reaction thrust of the device when in a natural stance.

Another feature of the invention is the suspension of the device wherein the motor and the abrasive feed systems remain stationery, and a relatively lightweight housing may be rotated about the motor axis so as to control the direction of abrasive blast. The invention also relates to a throwing wheel construction which is of a very simple configuration and construction, yet will not disintegrate in a manner so as to cause bodily harm to the operator.

Most important, there has been developed a suspension system for that portable abrasive throwing wheel device wherein the device is suspended from two cables with one of the cables sloping upwardly and forwardly generally at a 45° angle and the other suspension cable sloping upwardly and rearwardly at a very sharp angle so that the weight of the device per se resists the rearward movement which normally results from the reaction forces of the throwing wheel.

Yet another feature of the suspension system is the provision of a simple suspension cable drive wherein the device may be raised and lowered as is required in its operation.

The suspension system further includes a brake which prevents a carriage from traversing a support beam or boom from being released during the operation of the machine. This prevents the free floating of the suspension while there is a reaction force from the device. Otherwise, the device would be free to travel towards the operator and place an unexpected force on the operator.

With the above, and other objects in view that will hereinafter appear, the nature of the invention will be more clearly understood by reference to the following detailed description, the appended claims and the several views illustrated in the accompanying drawings.

FIG. 7 is a schematic perspective view showing the specific details of a suspension cable arrangement for the device.

FIG. 8 is an elevational view showing one type of abrasive supply system.

FIG. 9 is an enlarged fragmentary sectional view taken through one of the couplers of the abrasive supply system of FIG. 8 and shows the manner in which there is an air assist for the movement of the abrasives.

FIG. 10 is a schematic side elevational view of a typical portable abrasive throwing wheel device having a removable blast shield.

FIG. 11 is a perspective view showing the general details of another form of abrasive supply system.

FIG. 16 is a schematic of a combined hydraulic and electrical control circuitry.

Figure 1:
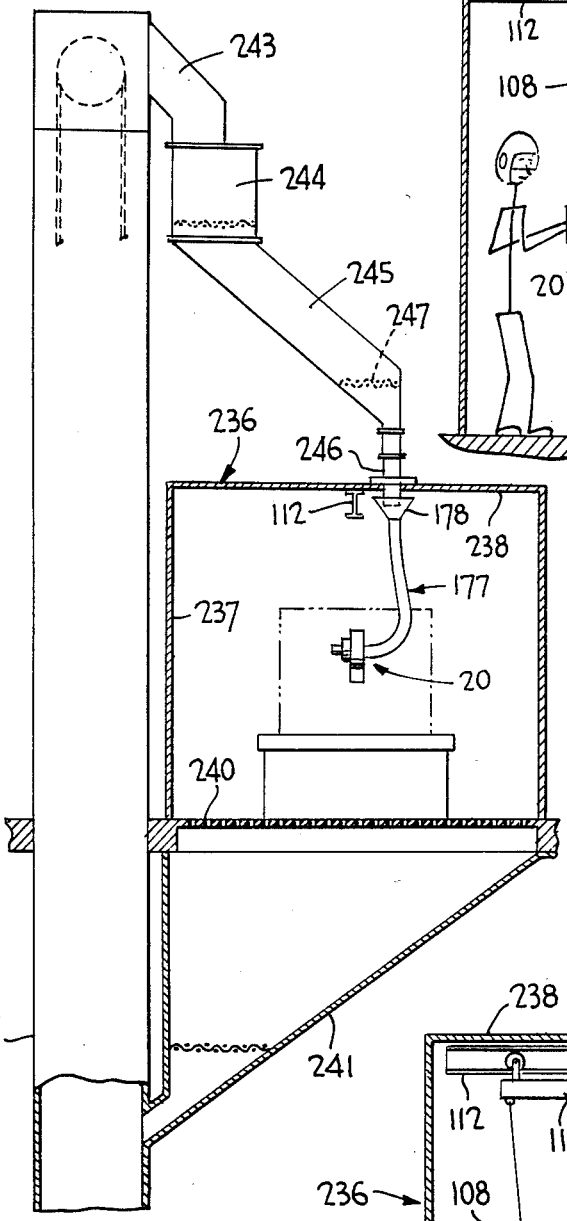
FIG. 1 is a schematic view showing the general use environment of the portable abrasive throwing wheel device and its function.

As will be readily apparent from the various figures of the drawings, this invention most particularly relates to a portable abrasive throwing wheel device or blast device, the constructional details thereof, the manner in which abrasives are delivered thereto, and the manner in which it is suspended. In order to best understand other features of the invention, it is believed that a full understanding of a preferred embodiment of the portable abrasive throwing wheel device or blast device is in order. Accordingly, reference is first made to FIG. 13 wherein such a device is illustrated and is generally identified by the numeral 20. The device 20 will be described generally in the manner in which it is assembled.

The device 20 includes a mounting flange, generally identified by the numeral 22. The mounting flange 22 includes a plate portion 23 which is formed at one side thereof with an annular mounting surface 24 defining a cylindrical recess 25. A hydraulic motor 26, which is purchased on the open market, has a terminal housing portion 27 which fits within the cylindrical recess 25. The motor 26 also includes a mounting flange 28 which is secured against the flange 24 by means of suitable bolts 29. The motor 26 is thus rigidly secured to the mounting flange 22.

On the other side of the plate portion 23, the mounting flange 22 also includes an annular flange 30. The annular flange 30 carries a bearing assembly generally identified by the numeral 31. The bearing assembly 31 is assembled with the mounting flange 22 prior to the mounting of the motor 26 and includes an outer bearing mounting ring 32 which is secured in place by a plurality of bolts 33 and which serves to clamp against the flange 30 an outer race of a conventional sealed radial bearing 34. The bearing assembly 31 also includes an inner bearing mounting ring 35 which is carried by the inner race member of the bearing 34 in a manner to be best described hereinafter.

In order to support the device 20, there is provided a hanger bracket 36 which includes a lower vertical leg 37 terminating in a mounting flange 38 which is secured to the outer bearing mounting ring 32 by bolts 40. The hanger bracket 36 includes an upper horizontal leg 41 to which a hanger eye 42 is secured. In the illustrated embodiment of the invention, the hanger eye 42 is threaded into the leg 41. On the other hand, the leg 41 could be formed in two pieces with one piece being horizontally slidable within the other so as to adjust the position of the hanger eye 42. At this time it is pointed out that the hanger eye 42 is utilized in suspending the device 20 for use.

The device 20 also includes a throwing or blast wheel housing 43 which includes an annular central portion 44 having integrally connected to the left side thereof a side plate 45. The side plate 45 is generally annular in outline and includes an outwardly projecting annular mounting flange 46. The flange 46 carries fasteners 47 which secure the inner bearing mounting ring 35 to the flange 46 and at the same time clamp the inner bearing race of the bearing 34 against the flange 46. In this manner the bearing assembly 31 mounts the housing 43 for relative rotation with respect to the mounting flange 22 and the motor 26.

The motor 26 includes a drive shaft 48 which extends through the mounting flange 22 generally into the housing 43. The drive shaft 48 carries on its end a customary two piece clamping hub assembly generally identified by the numeral 50. The clamping hub assembly 50 includes an inner part 51 which is fixed on the drive shaft 48 by means of a key 52. An outer part 53 is telescoped over the inner part 51 and the opposed tapered surfaces thereof serve to lock the two parts in place. When desired, the inner part 51 may be of split construction so as to be radially inwardly compressed to clamp the drive shaft 48.

Figure 17:
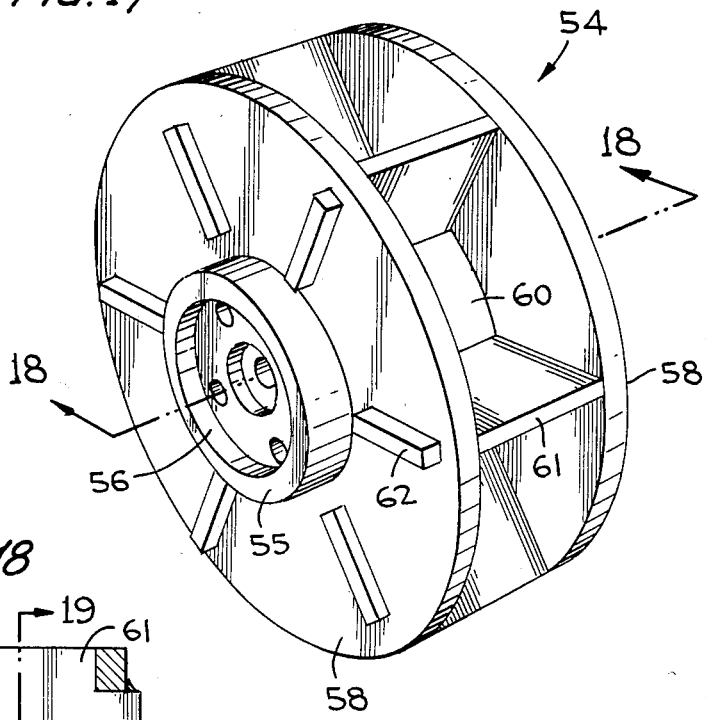
FIG. 17 is a perspective view of the throwing wheel of the device of FIG. 13.

The mounting hub assembly 50 mounts a throwing wheel or blast wheel 54 on the drive shaft 48 for rotation therewith and within the housing 43. The wheel 54 is of a special construction, as is best shown in FIGS. 17, 18 and 19.

Figure 13:
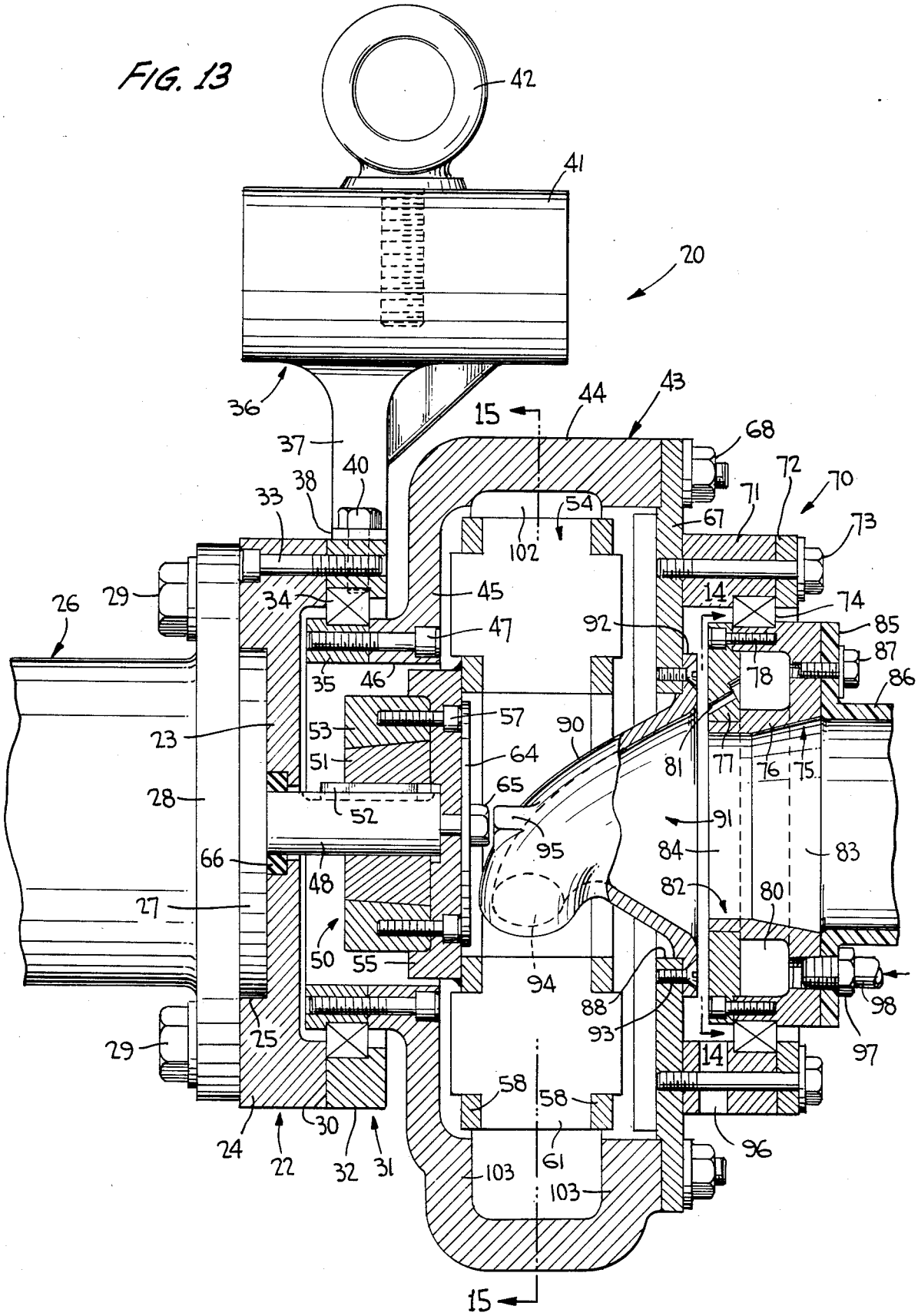
FIG. 13 is an elevational view with parts broken away and shown in section of a preferred embodiment of portable abrasive throwing wheel device formed in accordance with this invention.

The wheel 54 includes a mounting hub 55 which has formed in the left surface thereof a generally cylindrical recess 56 of a size to be snuggly received over the part 53 of the hub assembly 50. The hub member 55 is secured to the part 53 by means of fasteners 57, as is best shown in FIG. 13.

The wheel 54 also includes a pair of annular side plates 58 each having a large central opening 60 therethrough. Finally, the wheel 54 includes a plurality of vanes 61 arranged in radially extending relation and being circumferentially spaced between the side plates 58.

Figure 18:
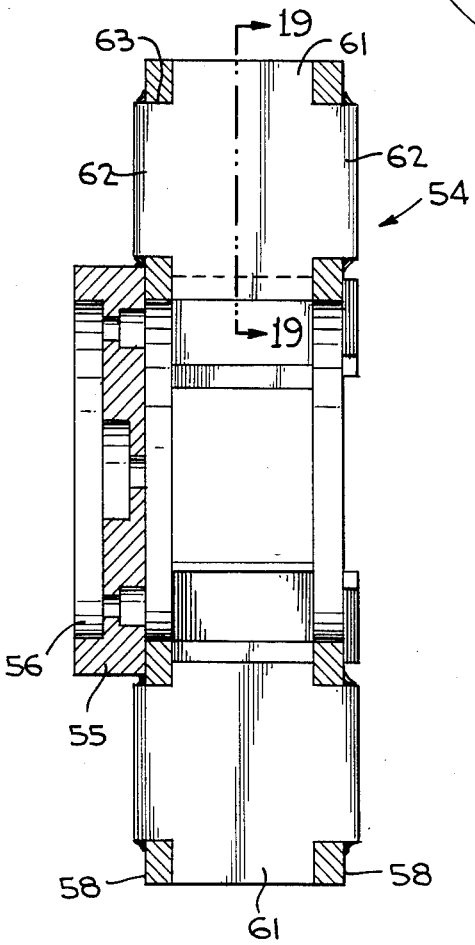
FIG. 18 is a horizontal sectional view taken generally along the line 18—18 of FIG. 17 and further shows the constructional details of the throwing wheel.
Figure 19:
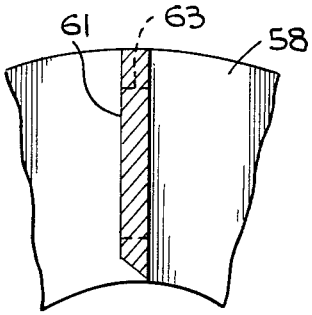
FIG. 19 is a fragmentary vertical sectional view taken through one of the vanes of the throwing wheel along the line 19—19 of FIG. 18.

As is best shown in FIG. 18, each vane 61 is provided at the opposite sides thereof with lugs 62. The lugs 62 are of the same size and are in alignment with one another. Further, each of the side plates 58 is provided with a radially extending through slot 63 for receiving a respective 1ug 62.

The side plates 58 and the vanes 61 are assembled by passing the lug 62 through the respective slot 63 in the side plates. With the side plates tightly disposed against the outer the edges of the vane 61, the lugs 62 are secured in place by welding the lugs 62 to the side plates 58 about the periphery of the lugs 62. Further, if additional strength is desired, lines of weld may also be formed along the side edges of the vanes 61 and against the inner surfaces of the side plates 58. Finally, the hub member 55 is secured to the adjacent side plate 58 by welding about the periphery of the hub 55.

The so formed wheel 54 is slid into the housing 43 through the open right side thereof and is assembled with the hub assembly 50 utilizing the bolts 57.

In order to prevent abrasive from coming into contact with the fasteners 57 and thereby possibly destroying the connections between the wheel 54 and the hub assembly 50, there is also provided a deflector plate 64. The deflector plate 64 is secured to the right face of the hub member 55 by a bolt 65 which normally will be threaded into the end of the drive shaft 48.

From the illustration of FIG. 13, it will be apparent that there is little possibility of abrasive entering into the general area between the hub assembly 50 and the mounting flange 22. However, although the motor 26 will be provided with its own shaft seal, a further shaft seal 66 will be mounted in the plate portion of the mounting flange 22 to seal against any possible movement of abrasive into the area of the motor 26.

The housing 43 is completed by a side plate 67 which is secured to the central annular portion 44 by suitable fasteners 68. The side plate 67, in turn, carries a second bearing assembly, generally identified by the numeral 70.

The bearing assembly 70 includes an outer bearing mounting ring 71 which associated therewith an annular clamping flange 72. Bolts 73 pass through the mounting ring 71 and the clamping flange 72 and serve to clamp within the mounting ring 71 an outer race member of a conventional sealed radial bearing 74.

The bearing assembly 70 also includes a special inner bearing mounting ring unit 75. The mounting ring unit 75 includes a generally C-shaped cross-sectional member 76 and an annular member 77. The annular member 77 is secured to the member 76 by means of a plurality of bolts 78 and in combination therewith clamp the inner race member of the bearing 74. The member 77, in combination with the member 76 also defines an annular air manifold 80. Finally, the member 77 has a plurality of circumferentially spaced, sloping bores therethrough opening into the manifold 80 and defining air jets 81.

The member 76, internally, defines an abrasive supply sleeve or tube 82 which has a tapered outer portion 83 and a cylindrical inner portion 84.

The member 76 also has clamped to the outer face thereof a mounting flange 85 of an abrasive supply line fitting 86 by means of bolts 87. Thus abrasives are delivered into the abrasive supply tube 82.

It is to be noted that the side plate 67 has a central opening 88 throughwhich there passes a spout portion 90 of an abrasive supply spout, generally identified by the numeral 91. The abrasive supply spout 91 includes a mounting flange 92 which is secured to the outer face of the side plate 67 surrounding the opening 88 by a plurality of bolts or screws 93.

The spout portion 90 is of a converging construction and terminates in a circular abrasive supply opening 94 positioned within the interior of the wheel 54 for delivering abrasive particles to the vanes 61 generally in a plane parallel to the plane of the side plates 67. Actually, when the housing 43 is in its normal position, the abrasive particles will be delivered to the wheel 54 generally at the four thirty position as shown in FIG. 13.

The abrasive supply spout 91 has a further feature of being provided with a projection 95 on the outer part of the spout portion 90 in alignment with the bolt 65. The projection 95 is in the form of a stop which, although it is spaced from the head of the bolt 65, will prevent the bolt 65 from being released, thereby holding the deflector plate 64 in position at all times.

It is to be understood that the abrasive particles delivered to the device 20 are fluidized and preferably carried by air. However, to make certain as to the flow of the abrasive particle into and through the spout 91, it will be seen that the cylindrical portion 84 of the abrasive supply tube 82 will be of a lesser diameter than the entrance diameter of the spout portion 90. It will also be seen that the air jets 81 will be directed into the conical outer portion of the spout portion 90 and serve to aerate and assist in the flow of the abrasives into and through the spout 91. It is to be understood, however, that air jets 81 in the general area of the lower portion of the spout portion 90 would create an undue disturbance. Therefore, the air jets 81 are ommitted from approximately 90° of the member 77. It is to be understood that the circumferential extent of the jet free area of the member 77 is due to the fact that the housing 43 is rotated relative to the spout 91 during the operation of the device 20 in the manner to be described hereinafter in detail.

It is also to be understood that the carrier air delivering the abrasive particles into the supply tube or sleeve 82 must be removed. Further, there will be a loss of certain of the abrasive particles passing from the supply sleeve 82 towards the spout 91. Accordingly, the ring member 71 is provided in the lower portion thereof with a suitable drain opening or openings 96. It will also be seen at the bottom right hand part of device 20 that a fitting 97 of an air supply line 98 opens into the manifold 80 for supplying air under pressure to the manifold 80 and out through the air jets 81.

It is to be understood that the motor 26 is preferably a hydraulic motor and will include a hydraulic fluid supply line, a hydraulic fluid return line and a drain line. These lines, of course, will be relatively stiff. They will also be associated with the abrasive supply line. Thus the mounting flange 22 and the supply sleeve 82 will be held against rotation. On the other hand, the wheel housing 43 and the associated parts of the bearing assemblies 31 and 70 will be free to rotate with practically no resistance to the rotation. By rotating the housing 43, in a manner to be described in detail hereinafter, the direction of the abrasive blast may be varied.

Figure 15:
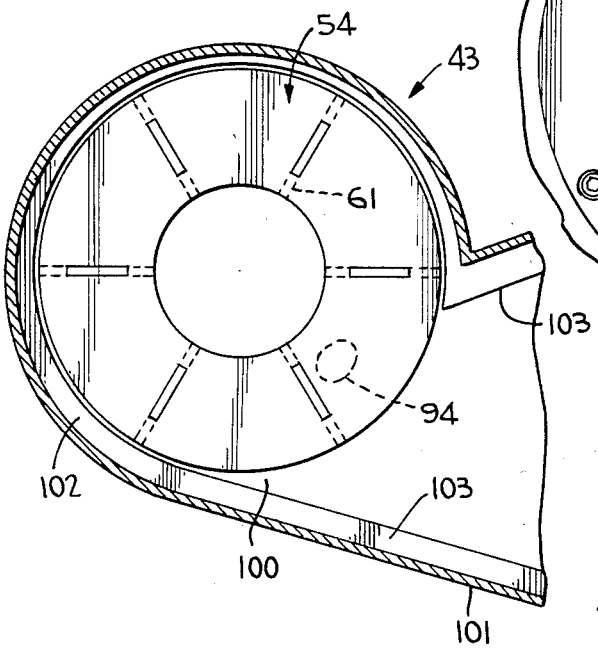
FIG. 15 is a fragmentary vertical sectional view taken generally along the line 15—15 and shows generally the construction of the throwing wheel and the relationship thereof to the housing therefor.

Referring now to FIG. 15, it will be seen that the housing 43 has an abrasive discharge opening 100. This opening is materially less than the diameter of the wheel 54 and in the event the wheel should come apart, the components thereof would not readily fly through the discharge opening 100. For example, the discharge opening 100 would have a height on the order of four inches while the wheel 54 would have a diameter on the order of seven inches.

It is also to be understood that while the blast of abrasive off of the wheel 54 will normally be controlled by the wheel 54, in order to control the stream of abrasive blast, there is provided a guard 101 which is an extension of the housing 43 or which may be in the form of a separate casting, as will be described in detail hereinafter.

Finally, with reference to FIG. 13, it will be seen that the annular portion 44 will have formed on the inner surface thereof a passage 102. The passage 102 will progressively increase in depth and thus will provide a flow passage for first abrasive particles passing off of the vanes 61. On the other hand, the construction of the housing 43 will be such that the side portions of the central annular portion 44 will be generally in the form of ribs 103. These ribs are spaced apart a greater distance than the width of the vanes 61, but a lesser distance than the width of the wheel 54. Generally speaking, the plates 58 will be aligned with the ribs 103 so that in the event the wheel 54 should become loose or partially disassembled, the plates 58 will strike the reinforced or thickened rib portions of the housing 43 and will be retained within the housing 43 until such time as the device 20 can be shut down. If desired, the same rib construction 103 may extend into the guard 101.

It is to be understood that by rotating the housing 43 about the axis of rotation of the wheel 54, the angular postion of the discharge opening 100 may be varied. Thus the abrasive blast stream may be tilted either up or down, depending upon the rotation of the housing 43. Further, since the abrasive supply spout 91 is fixed to the housing 43, it will rotate therewith. Therefore, the circumferential position of the discharge opening 94 will vary from the normal four thirty position illustrated in FIG. 15 either up or down. However, the relationship of the discharge opening 94 and the discharge opening 100 will remain constant so that the abrasive particles delivered to the vanes 61 will pass through the same rotational angle irrespective of the rotated position of the housing 43 and thus will be thrown from the vanes 61 at an optimum position.

Referring now to FIG. 10, it will be seen that, when desired, the abrasive blast guard 101 may be in a form of a separate casting 104. The housing 43 will also be cast so as to permit a readily detachable mounting of the guard 104. This includes a pivot connection 105 and a locking flange 106 carrying a locking bolt 107.

It is to be understood that the housing 43 and the wheel 54 will be formed of tough wear resistant materials. For example they may be formed of hardened manganese steel or any other equivalent materials which are conventionally utilized in conjunction with abrasive blast machines.

Referring now to FIG. 7 and with further reference to FIG. 13 where it will be apparent that the device 20 is supported by the hanger bracket 36, it will be seen that the device 20 is suspended by way of a suspension system generally identified by the numeral 108. The suspension system 108 is carried by a carriage 110 which is mounted by means of suitable support wheels or rollers 111 on a support beam 112. The carriage 112 has suitable depending hangers 114 depending therefrom. The hanger 113 carries a single groove pulley 115 while the hanger 114 carries a double groove pulley 116.

A first support cable 117 has its lower end secured to the eye 42 and passes first over the pulley 115 and then over the pulley 116. A second support cable 118 has its lower end secured to the eye 42 and passes up and around the pulley 116.

The support cables 117, 118 then pass around a double groove pulley 120 and then have their ends anchored as at 121 to the hanger 114. The pulley 120 is carried by a bracket 122 which, in turn, is positioned by means of a cable 123 carried by a winch 124 having a reversible hydraulic motor 125.

It is to be understood that the device 20 weighs on the order of 100 pounds. It is also to be understood that the reaction thrust or force F is on the order of 35 pounds. Thus if the device 20 is suspended by way of only the cable 118, while the device 20 would assume a normal position wherein the cable 118 is vertical, the reaction force F would swing the device 20 rearwardly through an angle A on the order of 20°. However, by utilizing the two support cables 117, 118, the rearward movement of the device 20 to the right as a result of the reaction force F is minimal. It will be seen that the support cable 117 is disposed at an angle on the order of 45° to both the vertical and the horizontal. Thus the vertical component of any resultant movement of the device 20 would have to overcome approximately 70 pounds in a vertical direction. Thus the rearward force on an operated device 20 is held to a minimum by the suspension system 108.

It is to be understood that by actuating the winch 124 to move the pulley 120 either to the left or the right permits an operator to vertically adjust the position of the device 20.

At this time, it is to he understood that the carriage 110 is normally held stationary on the beam 112 by means of a brake member 126 which is normally spring-loaded against the beam 112. The brake member 126 does, however, have a release mechanism 127 which may be electrically actuated, if so desired. This will be described in detail hereinafter.

At this time it is pointed out that the wheel housing 43 has a rearwardly extending positioning arm 128 which carries a transverse positioning 130 which, in turn, carries a pair of depending grip members 131, 132. The grip members 131, 132 carry individual control switches 133, 134, both of which must be closed before the motor 26 is actuated.

The grip member 131 also carries a control switch 136 for the winch motor 125 while the grip member 132 carries a control switch 137 for the brake solenoid 127.

Referring now to FIG. 16, it will be illustrated the hydraulic and electrical control schematic for the device 20. The hydraulic system includes a reservoir 138 to which there is connected a supply line 140 leading to a hydraulic pump 141. A pressure line 142 extends from the pump 141 and has coupled thereto adjacent the pump a relief line 143 leading back to the reservoir 138 and having mounted therein a pressure relief valve 144.

The pressure line 142 has also extending therefrom a line 145 which carries a pressure gauge 146.

A supply line 147 extends from the pressure line 142 to the hydraulic motor 26 and a return line 148 extends from the hydraulic motor 26 back to the reservoir 138. There is also a drain line 150 which also will be returned to the reservoir 138.

The supply line 147 has mounted therein a compensative flow control valve 151 which is preset to control the volume of hydraulic fluid flowing to the hydraulic motor 26 and thus controlling the speed of operation thereof.

There is also mounted across the supply line 147 and the return line 148 a normally closed control valve 152 which may be provided with any type of actuator, but is illustrated as having a solenoid actuator or positioner 153 for moving the valve 152 to its flow position.

There is also a relief line 154 which extends across the supply line 147 and the return line 148 adjacent the motor 26. An adjustable pressure actuated relief valve 155 is mounted in the relief line 154.

There is also a supply line 156 for the motor or rotary actuator 125, the supply line 156 being coupled to the fluid pressure line 142. The supply line 156 leads to a directional control valve 157 which also has connected thereto a return line 158 also coupled to the reservoir 138. The supply line carries a pressure reducing valve 160 which drains into the return line 158.

The motor or rotary actuator 125 has connected thereto a first flow line 161 and a second flow line 162. These are connected on the opposite side of the directional control valve 157 which is normally in a fully closed position. When the valve 157 is shifted in the down position, the first line 161 is connected to the supply line 156 and the second line 162 is connected to the return line 158 to rotate the motor 125 and the associated winch 124 in a first direction. When the valve 157 is moved up, the line 161 becomes connected to the return line 158 while the line 162 becomes connected to the supply line 156 so as to rotate the motor 125 and the associated winch in the opposite direction.

The lines 161 and 162 may be provided with pilot operated check valves 162 and flow control valves 164 of conventional types.

The directional control valve 157 may be actuated in any desired manner. However, for purposes of illustration, there are provided two solenoid controls 165 and 166. When the solenoid control 165 is energized, the valve 157 will move down and when the solenoid 166 is energized, the valve 157 will be moved up.

The electrical circuitry of the control system is schematically illustrated to include a power supply 167 which is grounded and has a main lead 168. A lead 170 extends from the main lead to the solenoid 153 and has incorporated therein the control switches 133 and 134. It will be seen that when both switches 133, 134 are closed, the solenoid 153 will be energized to switch the valve 152 to actuate the motor 26.

Another lead 171 extends from the lead 168 and branches into leads 173 and 174 with the lead 173 having incorporated therein the switch 136 and leading to the solenoid 127. The lead 173 also has incorporated therein a solenoid controlled relay 172 which is normally closed, but which is automatically opened when the switches 133 and 134 are both closed. Thus when the relay 172 is closed and the switch 136 is actuated to its closed position, the solenoid 127 will be energized, releasing the brake 126 and permitting movement of the carriage 110 along the beam 112.

Lead 174 is provided with a normally opened, two operative positions, selector switch 137 which selectively energizes a lead 175 or a lead 176, which lead to the solenoids 166 and 165, respectively. Thus when the selector switch 137 is actuated in one of the two positive directions, the device 20 may be raised or lowered depending upon the position of the selector switch 137.

Referring now to FIG. 8, it will be seen that there is illustrated an abrasive supply system for the device 20, the abrasive supply system being generally identified by the numeral 177. The abrasive supply system 177 is simply illustrated as having a hopper 178 which receives a stream of abrasive. An abrasive conduit 180 extends downwardly from the hopper 178 and has an abrasive size control unit 181 mounted therein. The unit 181 includes a housing 182 in which there is removably disposed a size control screen 179. The screen 179 serves the function of assuring the operator of the device 20 that no particle other than preselected abrasive size particles pass to the device 20. This eliminates the possibility of bolts or previously removed housing components, etc. from reaching the device 20 and damaging the throwing or blast wheel 54.

The supply system 177 includes a plurality of conduit sections 183 which may be straight or of varied curved shapes. Adjacent conduit sections 183 are joined by couplers, generally identified by the numeral 184.

Referring now to FIG. 9, it will be seen that each coupler is formed in two parts 185, and 186 joined together by suitable bolts 187.

The part 185 is the downstream part and has a bore 188 in its downstream face of a size to receive the upper end of a conduit section 183. In a like manner, the part 186 has a bore 190 for receiving the downstream end of a next upper conduit section 183. The ends of the two conduit sections 183 are in axially spaced relation.

The part 185 has an annular recess 191 in its upstream end which is closed by the part 186 and which forms an air manifold 191. The interior of the part 185, upstream of the associated conduit end, is enlarged as at 192 so as to define a generally downstream facing annular surface 193 throughwhich there extends a plurality of circumferentially spaced air jets 194 which open into the manifold 191 and receive compressed air therefrom. It will be readily apparent that the compressed air introduced into the upper end of the conduit section 183 by the air jets 194 will serve to entrain the abrasive particles passing through the conduit sections 183 and move the same towards the portable abrasive throwing wheel device 20.

It is to be understood that two compressed air lines are utilized. The aforementioned compressed air line or conduit 98 and a conduit or air line 195. The air line 98 is connected to each of the couplings 184 through a T-fitting 196. The air line 195 is connected to the air line 98 intermediate the last coupling 184 and the fitting 97 of FIG. 13 by way of a T-fitting 197. The purpose of the second air line 195 is that there is a constant air drop in the conduit 98 and the air line 195 serves to backfeed the line 98 as well as the manifold 80.

It is to be understood that there is a tendency for air pressure build up within the conduit sections 183. Accordingly, where appropriate, the downstream ends of the conduit sections 183 are provided with vent openings 198. The vent openings 198 are positioned on the upper parts of the conduit sections 183 so as to prevent loss of abrasive.

Although only the abrasive feed system has been illustrated in FIG. 8, it is to be understood that the hydraulic lines for the motor 26 and the electrical lines for the control switches will also be coupled in the feed system. Further, an air line to an operator's helmet may also be connected together as part of the system.

Figure 12:
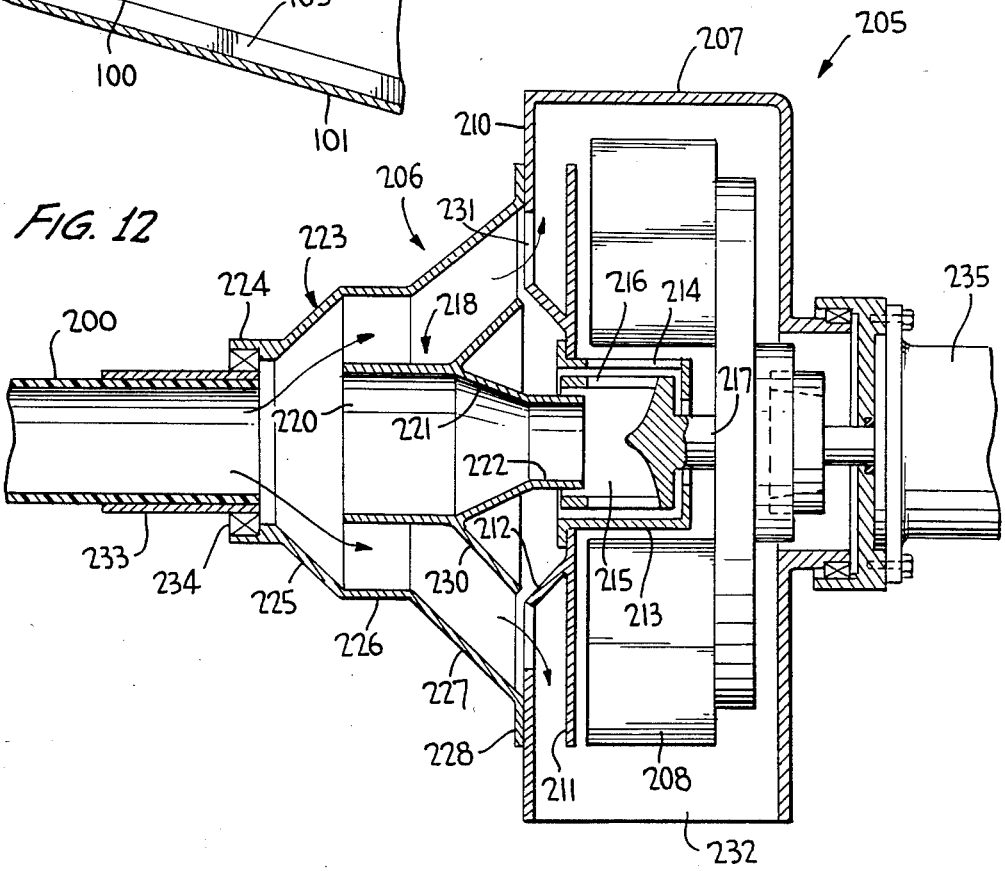
FIG. 12 is a fragmentary sectional view taken through a portion of the portable abrasive throwing wheel device and shows the manner in which the carrier air is removed from the abrasive.

Reference is now made to FIGS. 11 and 12 where there is illustrated a modified form of abrasive feed system. This system includes an abrasive conduit 200 which is provided at the upper end thereof with a positive air blower 201 for supplying air therethrough at a preselected rate and pressure. An abrasive feed conduit 202 opens into the abrasive conduit 200 downstream of the blower 201. The conduit 202 has mounted therein a rotary valve 203 which couples the abrasive feed conduit 202 with an abrasive hopper 204 while preventing backflow of air under pressure.

The abrasive line 200 is coupled to a slighty modified form of portable abrasive throwing wheel device, generally identified by the numeral 205. The device 205 includes an air separator 206 as will be described in detail hereinafter.

Referring now to FIG. 12, it will be seen that the device 205 includes a housing 207 in which there is mounted a throwing wheel 208 which may be of any construction, but is preferably of the same construction as the wheel 54.

The housing 207 has a side plate 210 on which the air separator 206 is mounted.

The side plate 210 carries an inner deflector plate 211 with the plate 211 being joined to the plate 210 by a generally frusto-conical web 212. A stator or case 213 is mounted on the plate 211 and extends into the interior of the wheel 208. The stator or case 213 has a fixed abrasive dispensing opening 214. Abrasive is directed through the opening 214 onto the vanes of the wheel 208 by way of an impeller 215 which is of a generally cup-shaped configuration and has dispensing openings 216 at circumferentially spaced intervals. The impeller 215 is connected to the wheel 208 by means of a shaft portion 217 for rotation with the wheel.

Abrasive is directed from the abrasive conduit 200 into the impeller 215 through an abrasive supply sleeve 218. The sleeve 218 includes an outer cylindrical portion 220 which is of a larger diameter than the conduit 200. The sleeve 220 then has a frusto-conical intermediate portion 221 which terminates in a cylindrical portion 222 of a lesser diameter. The cylindrical portion 22 has its free end disposed within the impeller 215.

It will be seen that abrasive passing into the air separator 206 from the abrasive conduit 200 will pass into the supply sleeve 220. On the other hand, the air carrier will have a tendency to expand and pass outside of the supply sleeve 220. The path of air is defined by an outer guide sleeve 223 which includes a cylindrical mounting portion 224, a tapered flared intermediate portion 225, a cylindrical intermediate portion 226 and a final tapered flared portion 227 which terminates in a mounting flange 228 which is secured to the side plate 210. There is also a flared frusto-conical guide member 230 carried by the abrasive supply sleeve 218 which cooperates with the sleeve 223 to defined an annular passage which opens into the interior of the housing 207 through a plurality of circumferentially spaced openings 231 formed in the side plate. The air passing into the housing 207 will exit through a discharge opening 232 together with the abrasive blast.

The mounting portion 224 is coupled to a conduit mounting sleeve 233 by means of a rotary connection including a bearing 234.

In the illustrated embodiment of the device 205, the wheel 208 is driven by a motor 235. At this time it is pointed out that while the illustrated arrangement of the components of the device 205 are somewhat different from those of the device 20, it is to be understood that the abrasive supply system of FIGS. 11 and 12 may be modified to be utilized in conjunction with the device 20.

Reference is now made to FIGS. 1–6 wherein various mountings for the portable abrasive throwing wheel device 20 are illustrated. Most particularly, with respect to FIG. 1, it is to be understood that the device 20 is utilized within a blasting room 236. The room 236 is constructed in a conventional manner and has metal sheet or plate walls 237 and roof 238. It also has a grating type floor 240 so that spent abrasive particles and removed matter may be collected in the manner to be described hereinafter.

Beneath the floor 240 is a hopper 241 which collects all matters passing through the grating 240. The hopper 241 opens into a vertical conveyor 242 which serves to elevate the collected material. At the upper end of the elevator 242, the collected material is dumped into a chute 243 which delivers the collected material to a separator 244. The separator serves to separate coarse material, including chunks of metal, from the abrasive particles. The finer material then passes down through a chute 245 into a conduit 246. The chute 245 has mounted in the lower portion thereof a finer opening grating or screen 247. As a final safeguard, the screen 179 of FIG. 8, which may be in the room 236, restricts all matter directed to the portable device 20 to abrasive particle size.

In the simplest form of the invention, the hopper 178 is fixed to the roof 238 as is the support beam 112. This, of course, limits the permissible movement of the portable device 20. However, as is clearly shown in FIG. 2, the portable device 20 may be tilted so that the abrasive blast may be generally horizontal or may be directed up or down. In a like manner, the portable device 20 may be raised or lower so that an article 248 to be cleaned may be blasted the full height thereof. It is also to be understood that the portable device 20 may be tilted both to the left and to the right so that all surfaces of the article 248 may be cleaned.

Figure 2:
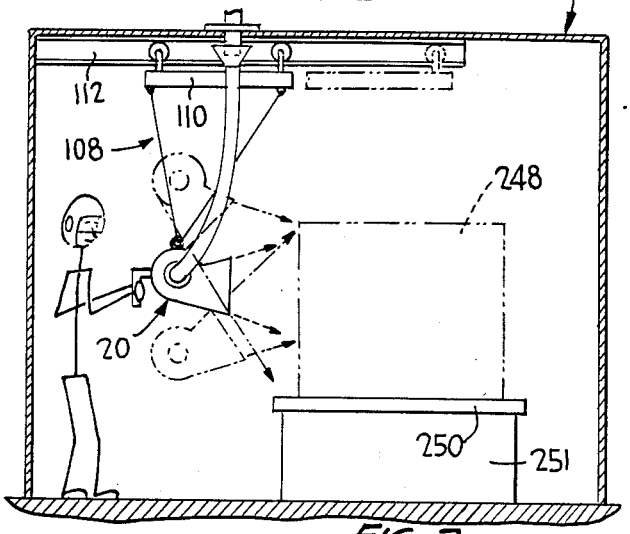
FIG. 2 is a fragmentary vertical sectional view of the device of FIG. 1 and shows the manner in which it is normally operated.

Inasmuch as the travel of the portable device 20 in the installation of FIGS. 1 and 2 is restricted, in order that the article 248 may be completely blasted, there is provided a rotary table 250 which is mounted on a suitable support 251. If desired, the support 251 may be in the form of a railway car and the floor of the blast room 236 may have rails incorporated therein.

Figure 3:
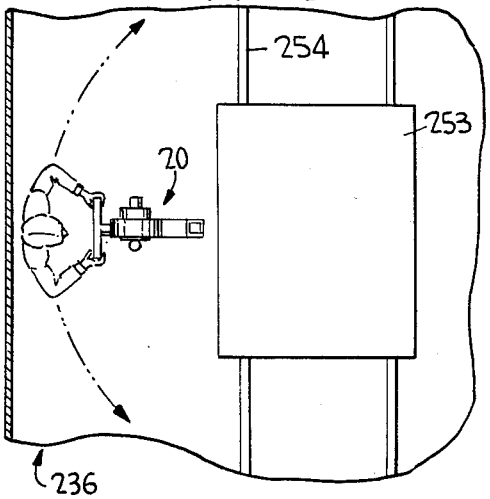
FIG. 3 is a plan view showing the normal manner in which the device is utilized in blasting a casting wherein the casting is mounted on a railway car.
Figure 4:
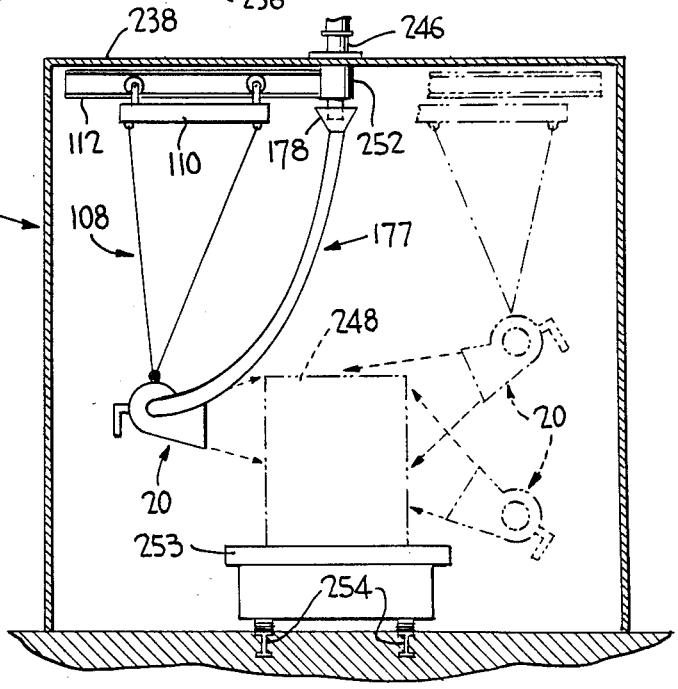
FIG. 4 is a vertical sectional view similar to FIG. 2 and shows a modified form of suspension wherein the beam is in the form of a boom rotatably mounted about the axis of the abrasive supply.
Figure 5:
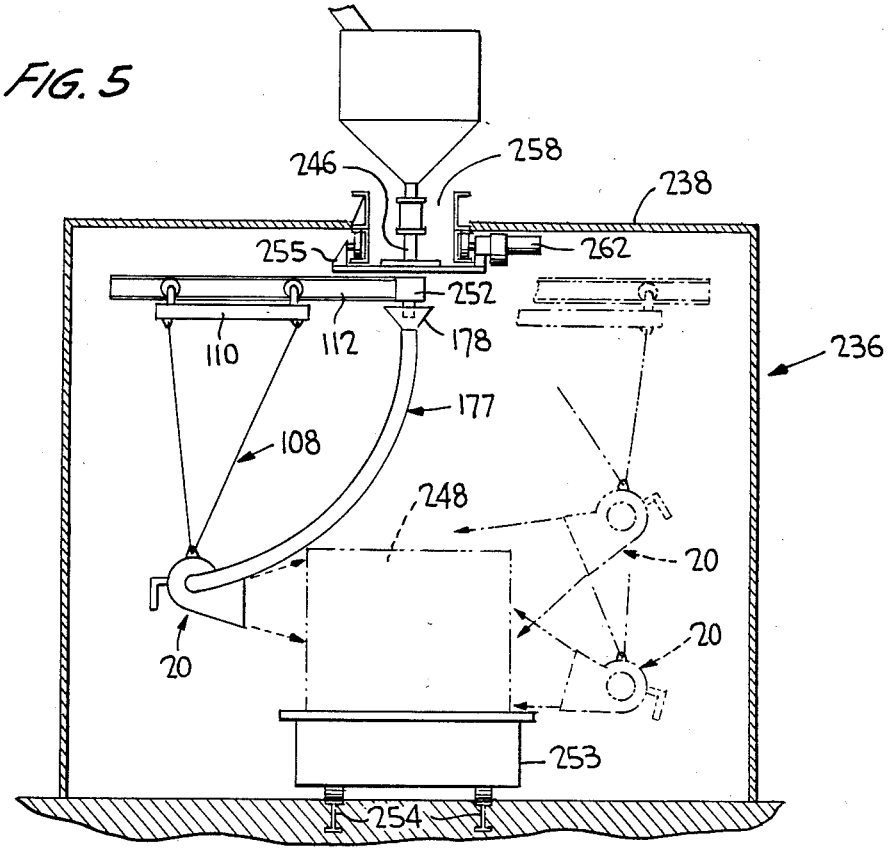
FIG. 5 is another transverse vertical sectional view showing another modified form of suspension wherein not only is the boom rotatable about the axis of the abrasive supply, but wherein the abrasive supply is movable longitudinally of the blasting room.

Reference is now made to the installation of FIGS. 3 and 4. In this installation, the beam 112 is in the form of a boom and is carried by a rotary support 252 which is mounted in the center of the roof 238 of the room 236. The conduit 246 extends through the rotary fitting 252 with the hopper 178 being rotatable about the same axis as the boom 112.

It will be readily apparent from FIGS. 3 and 4 that an operator of the portable device 20 may not only raise and lower the portable device and tilt the same as described with respect to the mounting of FIGS. 1 and 2, but also move the portable device 20 entirely around the article 248 which is being cleaned. With this mounting of the device 20, it is not necessary to mount the article to be cleaned on a rotary table. Instead, it is mounted on a railway car 253 which is moved into the center of the room on suitable tracks 254.

Figure 6:
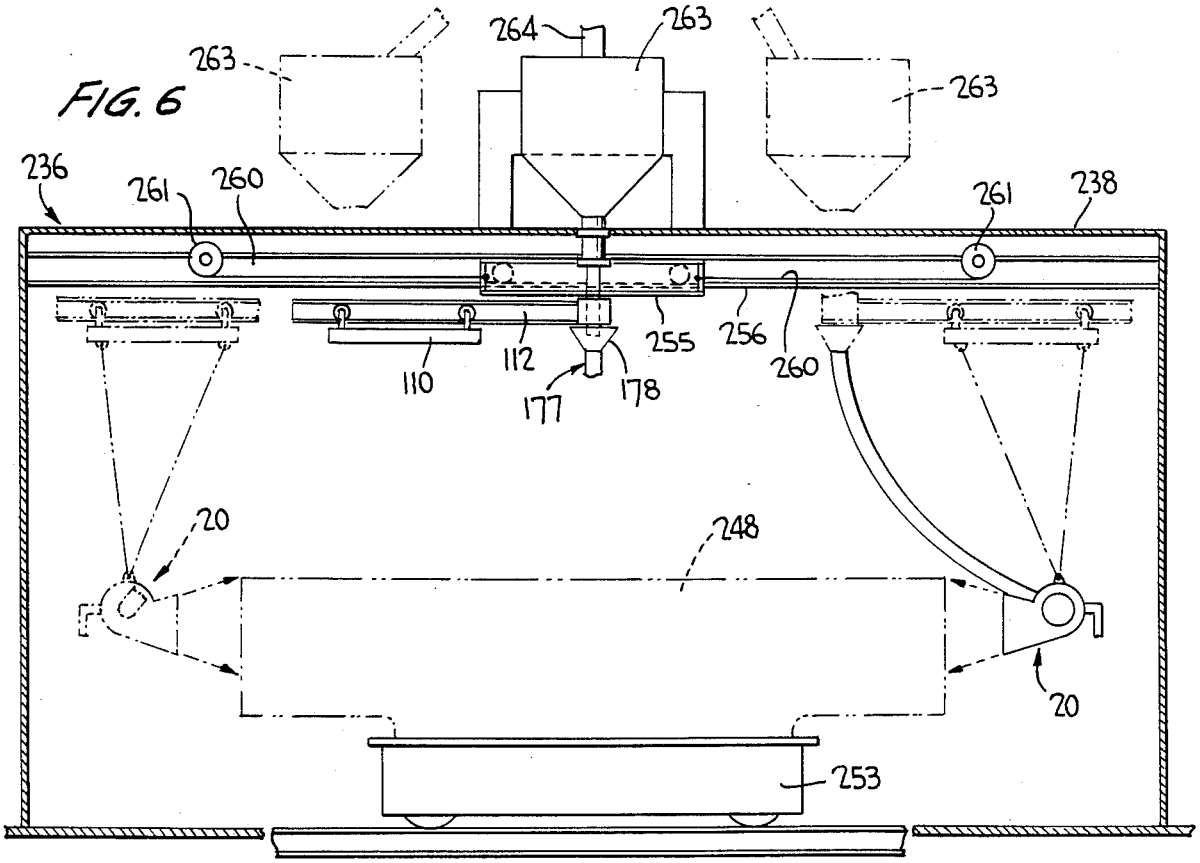
FIG. 6 is a longitudinal sectional view taken through the blasting room of FIG. 5 and shows further the details of the suspension of the device.
Figure 14:
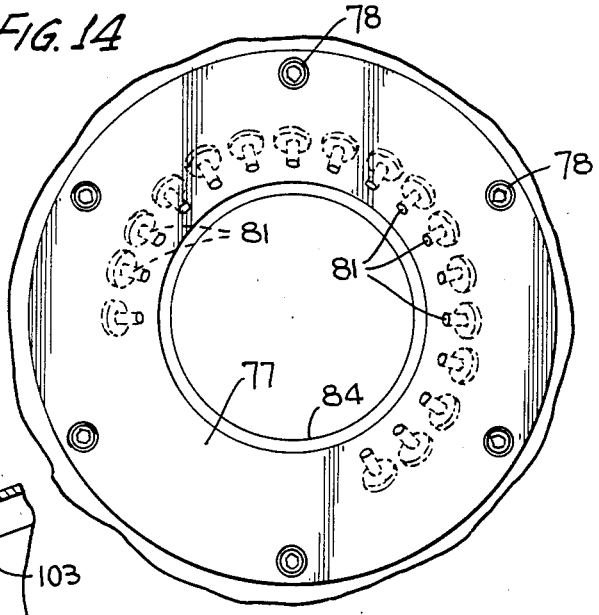
FIG. 14 is a fragmentary vertical sectional view taken generally along the line 14—14 of FIG. 13 and shows the general details of an air assist jet plate for directing abrasive into the throwing wheel.

Reference is now made to the mounting of the portable device 20 wherein maximum utilization may be obtained. Once again, the floor of the blast room 236 is provided with rails 254 which carry a car 253 which serves to suitably support the article 248 to be blasted. However, in this instance, the car 253 may be elongated as is best shown in FIG. 6 such that with the boom arrangement of FIGS. 3 and 4 the operator could not move the portable device 20 around the ends of the article 248. To this end, the rotary support 252 is carried by a carrier 255 which, in turn, is moved longitudinally of the blast room 236 on rails 256 suspended from the roof 238. The roof 238 has an elongated central opening 258 therein throughwhich the conduit 246 is movable. Thus the boom 112 is moved lengthwise of the room, as is schematically shown in FIG. 6.

In order that the opening 258 may always be closed, there is provided a pair of flexible curtains 260 which are reeled in housings 261 and attached to opposite ends of the carriage 255. Further, if desired, the carriage 255 may be provided with a suitable drive unit 262 to facilitate the movement thereof along the length of the blast room 236.

In order to permit the hopper 178 to be shifted longitudinally of the blast room, it is to be understood that there will be an upper hopper 263 mounted on the carriage 255 above the blast room 236. A suitable conduit 264, which is flexible, will direct abrasive into the upper hopper 263.

It will be readily apparent from the foregoing that there has not only been devised a commercially feasible portable abrasive throwing wheel device, but also feasible abrasive supply systems for such device. In addition, there has been provided a suitable suspension arrangement wherein very little thrust is placed upon an operator so that the operation of the portable device 20 is not too tiring on the operator. In fact, tests with the portable device 20 have shown that the work required by the operator is much less than that of the pneumatic abrasive nozzle type device. Further, there has been provided suitable support means which may be readily varied depending upon the blast installations wherein all types and sizes of articles may be blasted.

Although only preferred embodiments of the invention have been specifically illustrated and described herein, it is to be understood that minor variations may be made in the portable abrasive throwing wheel device, the suspension system therefor, the controls therefor, the abrasive feed thereto and the mounting thereof within blast rooms without departing from the spirit and scope of the inventions as defined by the appended claims.

We claim:

1. An abrasive supply unit for a portable abrasive throwing wheel device, said abrasive supply unit comprising a throwing wheel housing side plate, a fixed abrasive supply spout secured to said side plate and extending therethrough, a radial bearing assembly carried by said side plate and including an outer mounting ring unit, a radial bearing mounted in said outer mounting ring unit, an abrasive supply sleeve carried by said bearing for relative rotation between said abrasive supply sleeve and said spout, said spout having an entrance opening of a greater cross-sectional size than the interior of said abrasive supply sleeve, said abrasive supply sleeve defining an annular compressed air manifold, and air jets opening into said spout around said abrasive supply sleeve for facilitating abrasive flow into said spout.

2. An abrasive supply unit according to claim 1 wherein said spout has a discharge opening disposed in angular relation to said entrance openings, and said air jets being absent in the area of arcuate extent of said spout discharge opening.

3. An abrasive supply unit according to claim 1 wherein said side plate is generally vertically disposed, and drain means through a lower part of said outer mounting ring unit for draining air and abrasive missing said spout from said abrasive supply unit.

4. An abrasive supply system for a portable abrasive throwing wheel device, said abrasive supply system comprising a plurality of conduit members, and couplings joining together adjacent ones of said conduit members with ends of said adjacent conduit members being axially spaced, each of said couplings including a compressed air manifold, and air jets extending from each manifold into the interior of the respective coupling between said conduit sections joined together thereby and generally in the intended direction of abrasive flow.

5. An abrasive supply system according to claim 4 together with a gravity abrasive supply.

6. An abrasive supply system according to claim 4 wherein said conduit sections have air pressure relieving vent openings formed in top portions thereof adjacent their lower ends.

7. An abrasive supply system for a portable abrasive throwing wheel device, said abrasive supply system comprising an abrasive conduit having upper and lower ends, a positive and continuous air supply coupled to said conduit upper end, and abrasive supply including a rotating valve coupled to said conduit downstream of said air supply, and air removal means at the lower end of said conduit including a central abrasive receiving sleeve and a flared outer air receiving chamber surrounding said central abrasive receiving sleeve.

8. An abrasive supply system according to claim 7 wherein said air removal means are carried by a wheel housing having a throwing wheel mounted therein, a fixed supply control stator carried by said housing generally within the interior of said throwing wheel, and an impeller positioned within said stator and attached to said throwing wheel for rotation therewith.

* * * * *